US010737495B2

(12) United States Patent
Nakagawa et al.

(10) Patent No.: US 10,737,495 B2
(45) Date of Patent: Aug. 11, 2020

(54) LIQUID EJECTING APPARATUS AND MAINTENANCE METHOD OF LIQUID EJECTING APPARATUS

(71) Applicant: SEIKO EPSON CORPORATION, Tokyo (JP)

(72) Inventors: Shigenori Nakagawa, Tatsuno (JP); Hitotoshi Kimura, Matsumoto (JP); Junpei Yamashita, Azumino (JP); Kazuyoshi Mizuno, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/274,067

(22) Filed: Feb. 12, 2019

(65) Prior Publication Data

US 2019/0248142 A1 Aug. 15, 2019

(30) Foreign Application Priority Data

Feb. 13, 2018 (JP) ..... 2018-022824
Sep. 13, 2018 (JP) ..... 2018-171610

(51) Int. Cl.
*B41J 2/165* (2006.01)
*B41J 2/15* (2006.01)

(52) U.S. Cl.
CPC ..... *B41J 2/1652* (2013.01); *B41J 2/15* (2013.01); *B41J 2/16517* (2013.01); *B41J 2/16526* (2013.01); *B41J 2002/16529* (2013.01)

(58) Field of Classification Search
CPC ..... B41J 2/1652; B41J 2/15; B41J 2/16517; B41J 2/16526
See application file for complete search history.

(56) References Cited

U.S. PATENT DOCUMENTS 9,399,347 B1 * 7/2016 Mizuno ..... B41J 2/16508
2004/0113973 A1 * 6/2004 Nakashima ..... B41J 2/16526 347/35
2005/0078145 A1 4/2005 Inoue
2007/0070167 A1 3/2007 Kojima
2008/0246801 A1 10/2008 Carlson et al.
2011/0175957 A1 7/2011 Nishizaka
(Continued)

FOREIGN PATENT DOCUMENTS

JP 05-147219 A 6/1993
JP 2003-291372 A 10/2003
(Continued)

OTHER PUBLICATIONS

Extended European Search report issued in Application No. EP19156979 dated. Jun. 14, 2019.

*Primary Examiner* — Jason S Uhlenhake
(74) *Attorney, Agent, or Firm* — Workman Nydegger

(57) ABSTRACT

A liquid ejecting apparatus includes a transport belt that transports a medium in a transport direction in a state in which the medium is supported on a medium supporting surface, a liquid ejecting head that ejects a liquid from a plurality of nozzles formed on a nozzle surface with respect to the medium supported on the medium supporting surface of the transport belt, and a controller that performs a flushing operation of ejecting the liquid from the nozzles as a maintenance operation for the liquid ejecting head, on a flushing area on the medium supporting surface adjacent to the medium with an interval therebetween.

20 Claims, 7 Drawing Sheets

(56) References Cited

U.S. PATENT DOCUMENTS

| | | | |
|---|---|---|---|
| 2011/0261096 | A1 | 10/2011 | Watanabe |
| 2015/0239263 | A1 | 8/2015 | Ishizuka |

FOREIGN PATENT DOCUMENTS

| | | | |
|---|---|---|---|
| JP | 2004-130624 | A | 4/2004 |
| JP | 2005-119284 | A | 5/2005 |
| JP | 2005-119294 | A | 5/2005 |
| JP | 2005-319650 | A | 11/2005 |
| JP | 2006-116808 | A | 5/2006 |
| JP | 2006-240232 | A | 9/2006 |
| JP | 2009-056746 | A | 3/2009 |
| JP | 2009-148967 | A | 7/2009 |
| JP | 2010-106374 | A | 5/2010 |
| JP | 2011-143654 | A | 7/2011 |
| JP | 2011-206986 | A | 10/2011 |
| JP | 2012-240237 | A | 12/2012 |
| JP | 2014-008725 | A | 1/2014 |
| JP | 2015-157269 | A | 9/2015 |
| JP | 2015-202629 | A | 11/2015 |
| WO | 12/073907 | A | 6/2012 |

* cited by examiner

LIQUID EJECTING APPARATUS AND MAINTENANCE METHOD OF LIQUID EJECTING APPARATUS

BACKGROUND

1. Technical Field

The present invention relates to a liquid ejecting apparatus and a maintenance method of a liquid ejecting apparatus.

2. Related Art

A printing apparatus that transports a recording medium with a transport belt, ejects an ink as an example of a liquid from a nozzle, and performs printing on the recording medium, as disclosed in JP-A-2015-202629, is an example of a liquid ejecting apparatus. Among such printing apparatuses, there is an apparatus that performs so-called flushing which discards the ink from the nozzle to prevent clogging of the nozzle. The printing apparatus flushes an area of the transport belt, which does not overlap the recording medium.

Ink discharged from a nozzle by a flushing operation is attached to a recording medium on a transport belt. When the ink is attached to the recording medium, there is a possibility that the recording medium is contaminated.

Such a problem is not limited to a printing apparatus that discharges ink from a nozzle to flush the discharged ink to a transport belt, and is generally common in a liquid ejecting apparatus that ejects a liquid from a nozzle to flush the liquid to a transport belt.

SUMMARY

To solve the above-described problems, a liquid ejecting apparatus includes a transport belt that transports a medium in a transport direction in a state in which the medium is supported on a medium supporting surface, a liquid ejecting head that ejects a liquid from a plurality of nozzles formed on a nozzle surface with respect to the medium supported on the medium supporting surface of the transport belt, and a controller that performs a flushing operation of ejecting the liquid from the nozzles as a maintenance operation for the liquid ejecting head, on a flushing area on the medium supporting surface adjacent to the medium with an interval therebetween.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus and a maintenance method of the liquid ejecting apparatus will be described with reference to the drawings. The liquid ejecting apparatus is, for example, an ink jet printer that performs printing by ejecting a liquid such as an ink onto a medium such a cloth.

Figure 1:
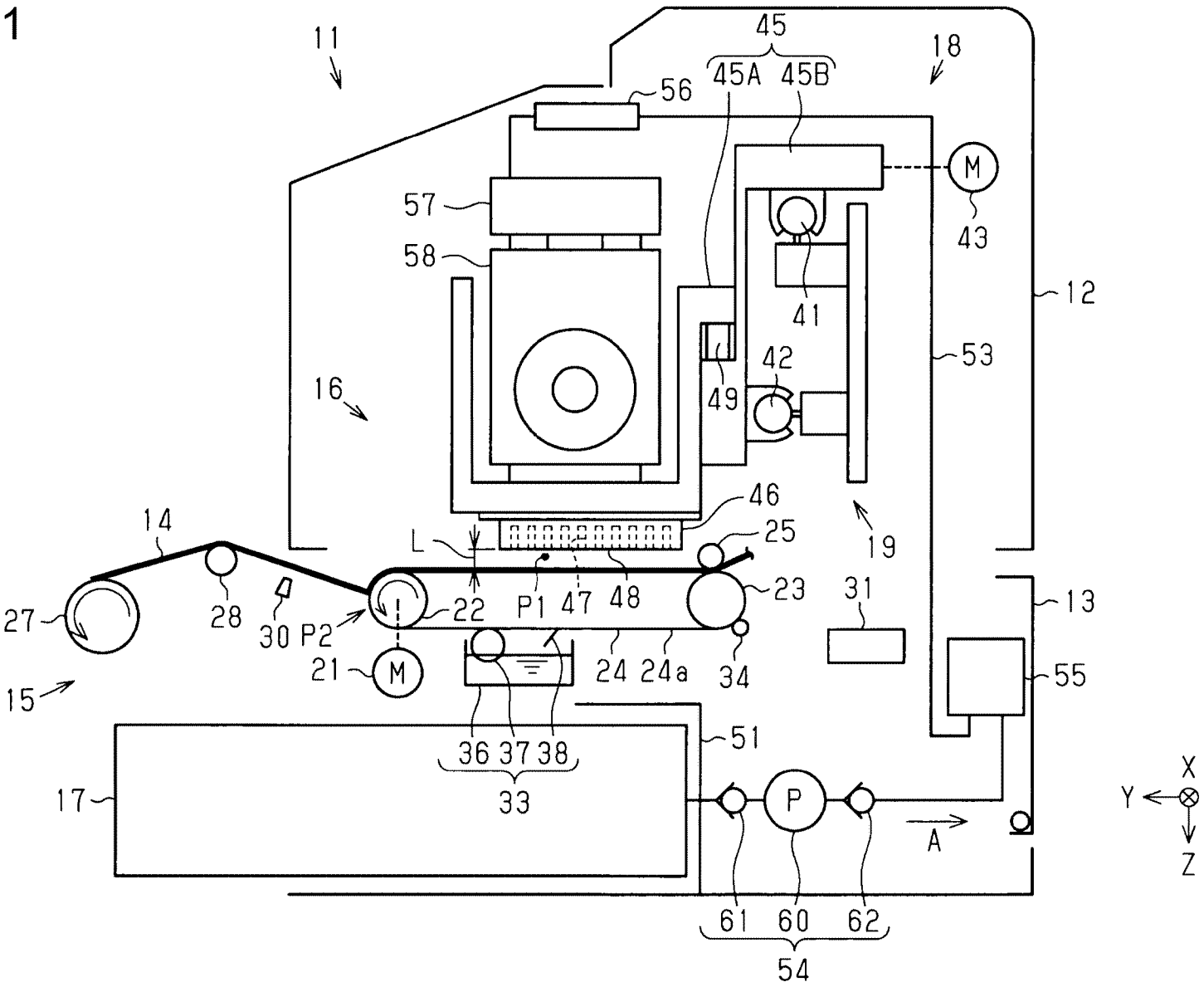
FIG. 1 is a schematic view illustrating a schematic configuration of an embodiment of a liquid ejecting apparatus.

As illustrated in FIG. 1, a liquid ejecting apparatus 11 includes a housing 12 and a cover 13 openably installed in the housing 12. The liquid ejecting apparatus 11 includes a transport unit 15 transports a medium 14, a liquid ejecting unit 16 that ejects a liquid to perform printing on the medium 14, a supply mechanism 18 that supplies a liquid accommodated in a liquid accommodating portion 17 to the liquid ejecting unit 16, and a movement mechanism 19 that moves the liquid ejecting unit 16.

In the drawing, the liquid ejecting apparatus 11 is placed on a horizontal surface. The direction of gravity is indicated as a Z axis, and directions along a surface intersecting the Z axis are indicated as an X axis and a Y axis. It is preferable that the X axis, the Y axis, and the Z axis be perpendicular to each other, and the X axis and the Y axis are along the horizontal plane. In the present embodiment, the X axis direction is a width direction of the medium 14, and is a direction in which the liquid ejecting unit 16 moves. In the present embodiment, the Y axis direction is a direction in which the medium 14 is transported in a printing position P1 where the printing is performed on the medium 14. In the present embodiment, the Z axis direction is a direction in which the liquid ejecting unit 16 ejects the liquid. In the following description, the X axis direction is referred to as a scanning direction X, the Y axis direction is referred to as a transport direction Y, and the Z axis direction is referred to as a vertical direction Z.

Next, an embodiment of the transport unit 15 will be described.

The transport unit 15 includes a transport motor 21, a driving pulley 22 that rotates by driving of the transport motor 21, and a driven pulley 23 that is rotatable about an axial line parallel to an axial line of the driving pulley 22. The transport unit 15 includes an annular transport belt 24 passing between the driving pulley 22 and the driven pulley 23, and a pressing roller 25 that presses the medium 14 against the transport belt 24. The pressing roller 25 presses the medium 14 and the transport belt 24 against the driven pulley 23 to sandwich the medium 14 between the pressing roller 25 and the driven pulley 23.

An inner peripheral surface of the transport belt 24 is in contact with the driving pulley 22 and the driven pulley 23. An outer peripheral surface of the transport belt 24 is a medium supporting surface 24*a* that supports the medium 14. The transport belt 24 according to the present embodiment is an adhesive belt in which the medium supporting surface 24*a* is coated with an adhesive, and peelably bonds and supports the medium 14. The transport belt 24 orbits around the driving pulley 22 and the driven pulley 23 as the transport motor 21 is driven, and transports the medium 14 in the transport direction Y while the medium 14 is supported on the medium supporting surface 24*a*.

The transport unit 15 includes a winding unit 27 that winds the printed medium 14 and a driven roller 28 located between the winding unit 27 and the transport belt 24. After being peeled off from the transport belt 24, the medium 14 transported by the transport belt 24 is wound on the winding unit 27 through the driven roller 28.

The liquid ejecting apparatus 11 includes a peeling sensor 30 that detects the medium 14 peeled off from the transport belt 24 and a controller 31 that totally controls driving of each mechanism such as the transport unit 15 and the liquid ejecting unit 16 in the liquid ejecting apparatus 11. The peeling sensor 30 is provided at a position between the transport belt 24 and the driven roller 28, which is a position along a transport path of the medium 14. The peeling sensor 30 is, for example, an optical sensor including a light emitting unit and a light receiving unit, and detects a distance between the peeling sensor 30 and the medium 14 by irradiating a light beam from a direction intersecting a surface of the medium 14. The controller 31 detects a peeling position P2 where the medium 14 is separated from the transport belt 24, based on a result of the detection by the peeing sensor 30. The controller 31 controls driving of the winding unit 27 such that the peeling position P2 is located lower than the medium 14 located in the printing position P1 in the vertical direction Z.

The liquid ejecting apparatus 11 includes a cleaning unit 33 for cleaning the transport belt 24 with a cleaning liquid and an absorption roller 34 that can absorb the cleaning liquid. The absorption roller 34 is a roller that can absorb a liquid at a portion in contact with the transport belt 24 and, for example, uses a cloth. The absorption roller 34 holds the transport belt 24 together with the driven pulley 23, and assists in removing the cleaning liquid and the liquid adhering to the transport belt 24. The cleaning unit 33 and the absorption roller 34 is provided to be movable between a position illustrated in FIG. 1 where the cleaning unit 33 and the absorption roller 34 come into contact with the transport belt 24 by driving a not-illustrated cleaning motor and a not-illustrated position where the cleaning unit 33 and the absorption roller 34 are separated from the transport belt 24.

The cleaning unit 33 includes a cleaning liquid accommodating portion 36 that accommodates the cleaning liquid, a cleaning brush 37 that comes into contact with the transport belt 24 to clean the transport belt 24, and a cleaning wiper 38 that removes the cleaning liquid and the liquid attached to the transport belt 24. The cleaning liquid is, for example, a liquid or water containing a detergent component such as a surfactant. The cleaning unit 33 may include a plurality of cleaning wipers 38.

Next, an embodiment of the liquid ejecting unit 16 and the movement mechanism 19 will be described.

The movement mechanism 19 includes a first guide shaft 41 and a second guide shaft 42 provided to extend in the scanning direction X and a carriage motor 43.

The liquid ejecting unit 16 includes a carriage 45 which is guided by the first guide shaft 41 and the second guide shaft 42 and can reciprocate in the scanning direction X and at least one liquid ejecting head 46 installed at a lower end portion of the carriage 45. In the present embodiment, four liquid ejecting heads 46 are installed in the carriage 45. The carriage motor 43 is a motor that moves the carriage 45.

Each of the liquid ejecting heads 46 has a nozzle surface 48 on which a plurality of nozzles 47 are formed. The liquid ejecting head 46 is provided such that the nozzle surface 48 faces the transport belt 24 or the medium 14 supported on the transport belt 24 in the vertical direction Z. The liquid ejecting head 46 ejects the liquid from the plurality of nozzles 47 to perform the printing on the medium 14, while moving in the scanning direction X intersecting the transport direction Y with respect to the medium 14 supported on the medium supporting surface 24*a* of the transport belt 24.

The carriage 45 includes a carriage body 45A in which the liquid ejecting head 46 is installed, a carriage base 45B guided by the first guide shaft 41 and the second guide shaft 42, and an adjustment mechanism 49 that adjusts a position of the carriage body 45A with respect to the carriage base 45B. The adjustment mechanism 49 includes, for example, a cam or the like. The adjustment mechanism 49 slides the carriage body 45A with respect to the carriage base 45B in the vertical direction Z. The adjustment mechanism 49 changes a distance L between the nozzle surface 48 and the medium supporting surface 24*a* in the vertical direction Z intersecting the transport direction Y and the scanning direction X. The adjustment mechanism 49 may be operated by a user or driving of the adjustment mechanism 49 may be controlled by the controller 31.

Next, an embodiment of the supply mechanism 18 will be described.

The liquid ejecting apparatus 11 includes a mounting portion 51 on which at least one liquid accommodating portion 17 is detachably mounted. The liquid ejecting apparatus 11 may include a plurality of supply mechanisms 18 according to the number of the liquid accommodating portions 17 that can be mounted on the mounting portion 51. In the present embodiment, four liquid accommodating portions 17 can be mounted on the mounting portion 51, and the liquid ejecting apparatus 11 includes four supply mechanisms 18. Each of the supply mechanisms 18 supplies the liquid to the corresponding liquid ejecting head 46.

The plurality of liquid accommodating portions 17 accommodate different liquids, respectively. When the plurality of liquid accommodating portions 17 accommodate inks having different colors such as cyan, magenta, yellow, and black, the liquid ejecting unit 16 ejects inks having a plurality of colors, supplied from the liquid accommodating portion 17, to perform color printing on the medium 14. The liquid accommodating portion 17 can accommodate, for example, inks having colors such as light magenta, light cyan, light yellow, ash, orange, and white or may accommodate a moisturizing liquid or a cleaning liquid. Kinds of the liquids ejected by the liquid ejecting unit 16 may include, for example, three colors such as cyan, magenta, and yellow or may include one color such as black.

The supply mechanism 18 includes a supply path 53 through which the liquid is supplied from the liquid accommodating portion 17 mounted on the mounting portion 51 to the liquid ejecting head 46. The supply mechanism 18 causes the liquid to flow in the supply direction A from a downstream side that is the liquid accommodating portion 17 side to a downstream side that is the liquid ejecting head 46 side. A supply pump 54 that causes the liquid to flow, a filter unit 55 that captures air bubbles and foreign matters in the liquid, a static mixer 56 that changes flow of the liquid of the supply path 53 to stir the liquid, a liquid storing chamber 57 that stores the liquid, and a pressure adjusting unit 58 that adjusts a pressure are provided in the supply path 53 in an order from an upstream side of the supply direction A.

The supply pump 54 has a diaphragm pump 60, the volume of a pump chamber of which is varied, a suction valve 61 disposed between the diaphragm pump 60 and the liquid accommodating portion 17, and a discharge valve 62 disposed between the diaphragm pump 60 and the filter unit 55. The suction valve 61 and the discharge valve 62 are one-way valves that allow flow of the ink to the downstream side and block flow of the ink to the upstream side. The supply pump 54 sucks the liquid from the liquid accommodating portion 17 side through the suction valve 61 as the volume of the pump chamber of the diaphragm pump 60 increases, and discharges the liquid from the liquid ejecting head 46 side through the discharge valve 62 as the volume of the pump chamber decreases.

The filter unit 55 is mounted detachably with respect to the supply path 53. The filter unit 55 is disposed at a position corresponding to the cover 13 and can be replaced by opening the cover 13.

Figure 2:
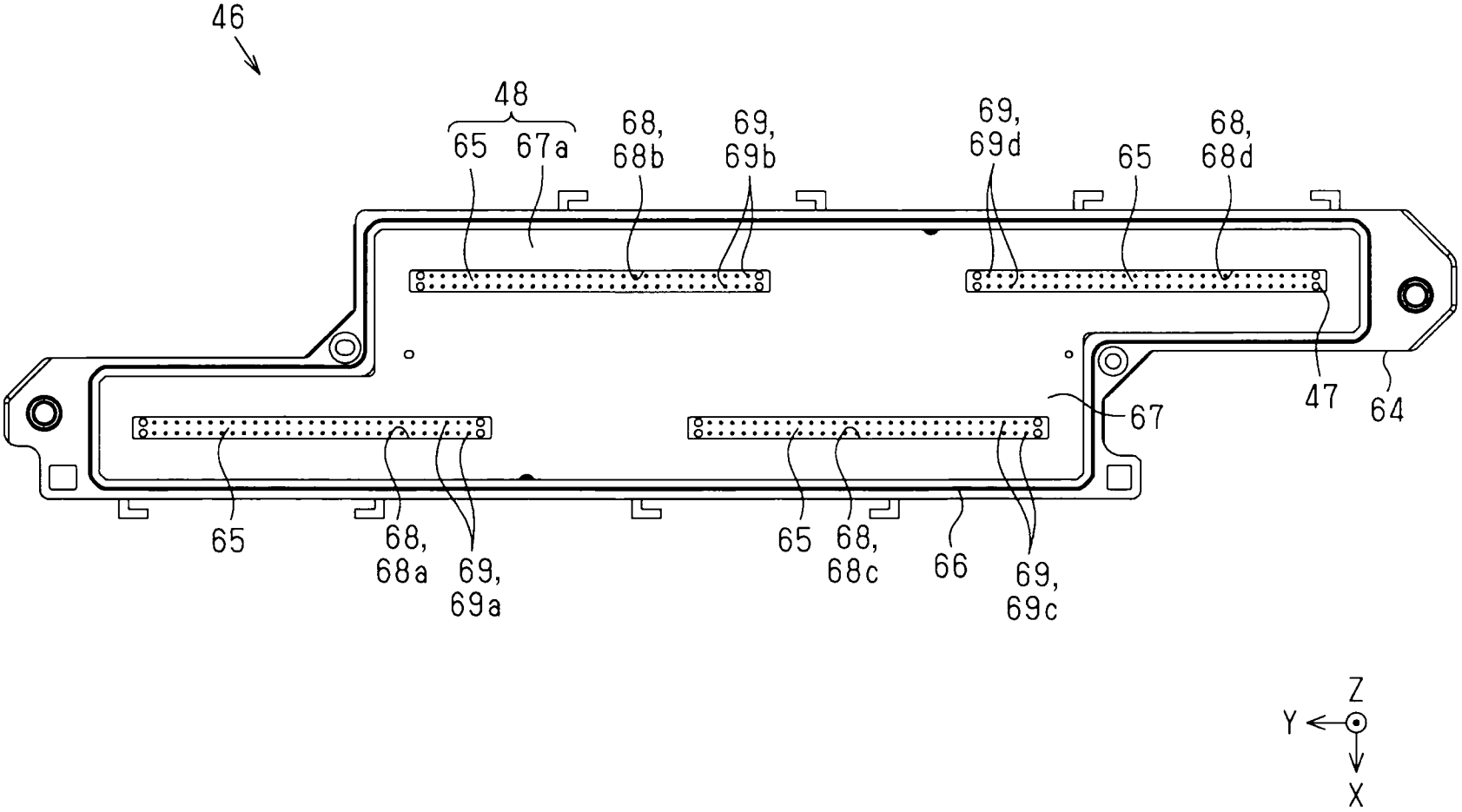
FIG. 2 is a bottom view illustrating a liquid ejecting head.

As illustrated in FIG. 2, the liquid ejecting head 46 includes a bracket 64 for installing the liquid ejecting head 46 in the carriage 45, a head body 66 having a nozzle opening surface 65 on which the plurality of nozzles 47 are opened, and a plate 67 that covers the nozzle opening surface 65.

The plate 67 is, for example, made of metal such as stainless steel, and is shaped such that two rectangular shapes in which the transport direction Y is set as a lengthwise direction when viewed from the lower side are misaligned in the transport direction Y. At least one through-hole 68 is formed in the plate 67. In the present embodiment, a first through-hole 68*a* to a fourth through-hole 68*d* constituting a rectangular shape that is long in the transport direction Y are formed in the plate 67. The plate 67 is fixed to the head body 66 such that the nozzles 47 are exposed from the through holes 68. The nozzle surface 48 is configured with the nozzle opening surface 65 exposed from the through-holes 68 and a lower surface 67*a* of the plate 67.

The plurality of through-holes 68 are formed to be shifted in the transport direction Y. The through-holes 68 are defined as the first through-hole 68*a*, a second through-hole 68*b*, a third through-hole 68*c*, and the fourth through-hole 68*d* in an order from the downstream side in the transport direction Y. The second through-hole 68*b* is located at an intermediate position between the first through-hole 68*a* and the third through-hole 68*c* in the transport direction Y. The third through-hole 68*c* is located at an intermediate position between the second through-hole 68*b* and the fourth through-hole 68*d* in the transport direction Y.

The first through-hole 68*a* and the third through-hole 68*c* are located at the same position in the scanning direction X to be spaced apart from each other in the transport direction Y. The second through-hole 68*b* and the fourth through-hole 68*d* are located at the same position in the scanning direction X to be spaced apart from each other in the transport direction Y. In the scanning direction X, the first through-hole 68*a* and the third through-hole 68*c* are located in positions that are different from the position of the second through-hole 68*b* and the fourth through-hole 68*d* to be spaced apart from the second through-hole 68*b* and the fourth through-hole 68*d, respectively.*

The liquid ejecting head 46 has a first nozzle group 69*a* to a fourth nozzle group 69*d* each having a large number of the nozzles 47 arranged at a constant pitch in the transport direction Y. The first nozzle group 69*a* is exposed from the first through-hole 68*a*, the second nozzle group 69*b* is exposed from the second through-hole 68*b*, the third nozzle group 69*c* is exposed from the third through-hole 68*c*, and the fourth nozzle group 69*d* is exposed from the fourth through-hole 68*d*. The first nozzle group 69*a* and the third nozzle group 69*c* are formed at the same position in the scanning direction X and are arranged in a row in the transport direction Y. The second nozzle group 69*b* and the fourth nozzle group 69*d* are located at the same position in the scanning direction X and are arranged in a row in the transport direction Y.

A part of the first nozzle group 69*a* and a part of the second nozzle group 69*b*, a part of the second nozzle group 69*b* and a part of the third nozzle group 69*c*, and a part of the third nozzle group 69*c* and a part of the fourth nozzle group 69*d* overlap each other when viewed from the scanning direction X. That is, the first nozzle group 69*a* to the fourth nozzle group 69*d* constitute a nozzle row 69 continuing in the transport direction Y when viewed from the scanning direction X. One nozzle row 69 ejects the same kind of liquid. A plurality of nozzle rows 69 may be formed in the liquid ejecting head 46.

Figure 3:
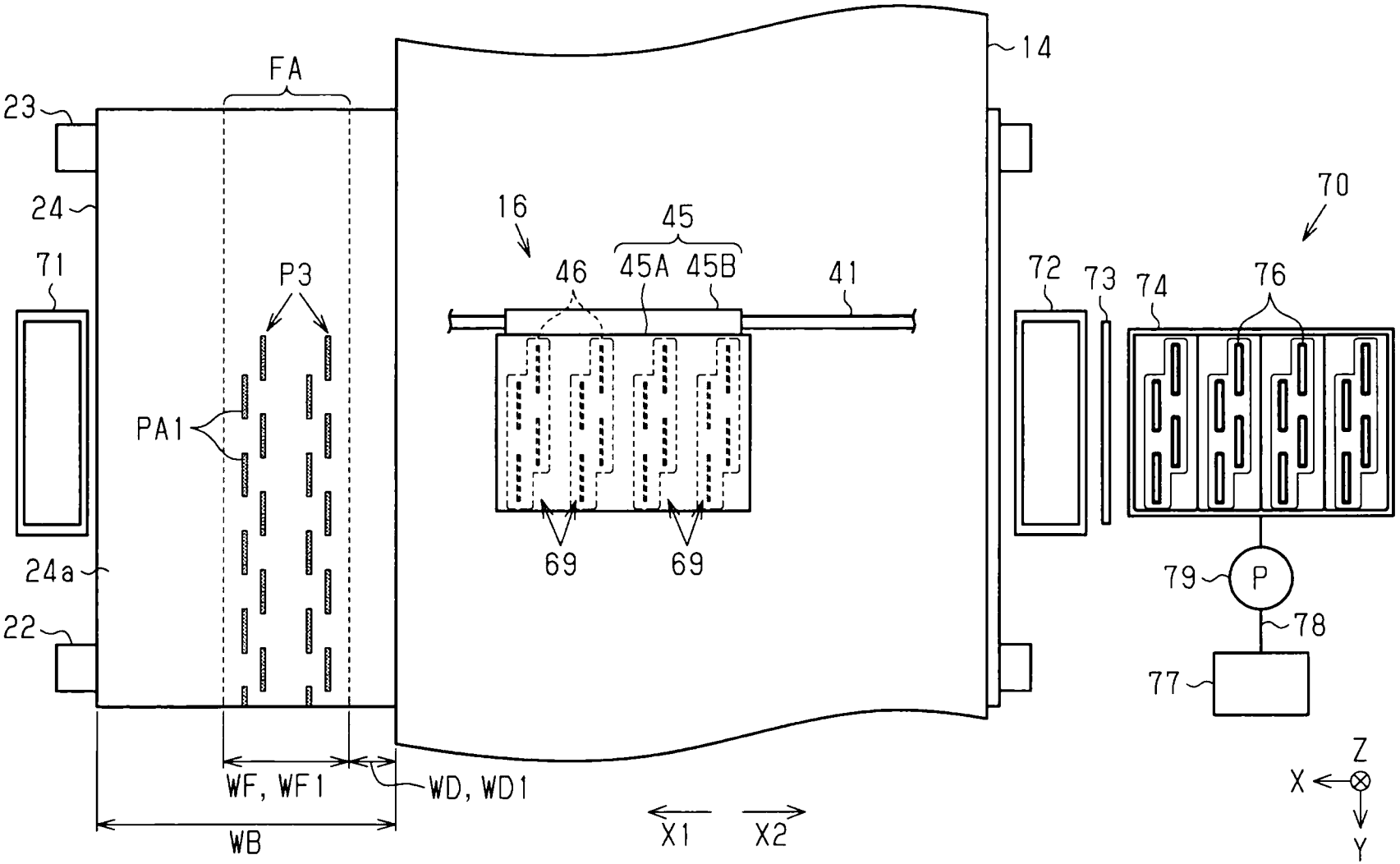
FIG. 3 is a schematic plan view illustrating a transport belt that transports a narrow medium and a maintenance mechanism.

As illustrated in FIG. 3, four liquid ejecting heads 46 are arranged in parallel to each other at a constant pitch in the scanning direction X. Configurations of the liquid ejecting heads 46 are the same. Therefore, the plurality of nozzle rows 69 are arranged in parallel to each other at a constant pitch in the scanning direction X. That is, the plurality of nozzles 47 are arranged on the nozzle surface 48 to form the plurality of nozzle rows 69 arranged in the scanning direction X. A plurality of different kinds of liquids can be ejected from the plurality of nozzle rows 69.

The transport belt 24 has a flushing area FA in which the liquid ejected from the nozzles 47 is accommodated by a flushing operation that is a maintenance operation of the liquid ejecting head 46. The flushing area FA is an area on the medium supporting surface 24*a*.

The flushing operation is an operation of ejecting the liquid from the nozzles 47 separately from ejection of the liquid to the medium 14 to be printed, in order to prevent or resolve clogging of the nozzles 47. Foreign matters, air bubbles, and altered liquids, which cause ejection failure, can be discharged through the flushing operation. An example of the altered liquids is thickened ink. The flushing operation is executed to resolve a mild ejection failure.

As illustrated in FIG. 3, in the present embodiment, the medium 14 is disposed close to one end side of the medium supporting surface 24*a*, and the flushing area FA is provided on the other end side of the medium supporting surface 24*a* in the scanning direction X. The medium supporting surface 24*a* can support the medium 14 at a predetermined position in the scanning direction X. Therefore, for example, the medium 14 may be disposed at a center of the medium supporting surface 24*a* in the scanning direction X, and the flushing areas FA may be provided on opposite sides of the medium 14.

Figure 4:
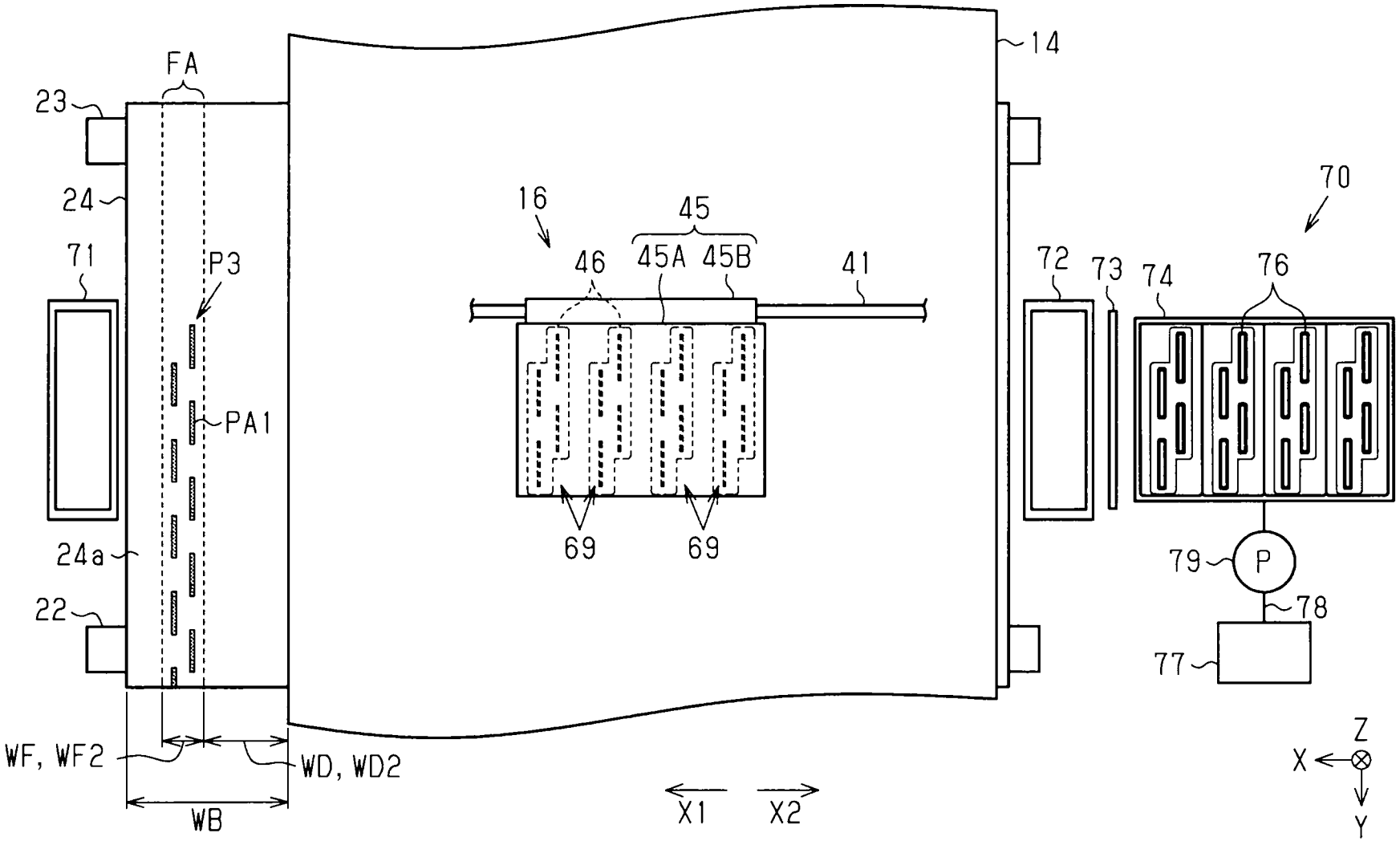
FIG. 4 is a schematic plan view illustrating a transport belt that transports a wide medium and a maintenance mechanism.

As illustrated in FIGS. 3 and 4, in the transport belt 24, the size of a portion of the medium supporting surface 24*a*, which is exposed without being covered by the medium 14, in the scanning direction X is defined as an exposure width WB. The exposure width WB is a size from an end of the medium 14 to an end of the transport belt 24. The exposure width WB varies depending on the width of the medium 14 and the position where the medium 14 is disposed. That is, as illustrated in FIG. 3, when the width of the medium 14 is small, the exposure width WB is large. As illustrated in FIG. 4, when the width of the medium 14 is large, the exposure width WB is small.

The controller 31 may acquire the exposure width WB based on width information of the medium 14 included in printing data. Further, a sensor that detects an end position of the medium 14 is provided in the liquid ejecting apparatus 11, and the controller 31 may acquire the exposure width WB based on a result of the detection by the sensor.

In the scanning direction X, the width of the flushing area FA is defined as a flushing width WF. The flushing width WF is a width necessary for accommodating the liquid ejected by the flushing operation, and is changed according to the type of the flushing operation. The controller 31 may perform a plurality of kinds of flushing operations. For example, the controller 31 may perform a simultaneous flushing operation of ejecting the liquid from the plurality of nozzle rows 69 together as illustrated in FIG. 3, and an individual flushing operation of ejecting the liquid in a state a timing is shifted according to each nozzle row 69 as illustrated in FIG. 4.

In the present embodiment, the controller 31 selects the simultaneous flushing operation when an ejection amount that is the amount of the liquid ejected in one flushing operation is equal to or more than a set value, and selects the individual flushing operation when the ejection amount is less than the set value. The number of attachment positions P3 of the flushing area FA, to which the liquid is attached, in the simultaneous flushing operation is larger than the number of the attachment positions P3 of the flushing area FA, to which the liquid is attached, in the individual flushing operation. That is, the controller 31 makes the number of the attachment positions P3 of the liquid in the flushing area FA when the amount of the liquid ejected to the flushing area FA is equal to or more than the set value more than the number of the attachment positions P3 of the liquid in the flushing area FA when the amount of the liquid ejected to the flushing area FA is less than the set value. A first flushing width WF1 when the simultaneous flushing operation is performed is larger than a second flushing width WF2 when the individual flushing operation is performed.

The nozzle rows 69 include a first nozzle group 69*a* to a fourth nozzle group 69*d* having different positions in the scanning direction X. Therefore, when the liquid is ejected from each nozzle row 69, intermittent patterns PA1 that are intermittent in the transport direction Y are formed in the attachment positions P3.

As illustrated in FIGS. 3 and 4, the flushing area FA is adjacent to the medium 14 with an interval WD therebetween in the scanning direction X. The size of the interval WD is set by the controller 31. The controller 31 sets the interval WD according to, for example, the distance L illustrated in FIG. 1 or a speed at which the liquid ejecting unit 16 moves in the scanning direction X.

Figure 5:
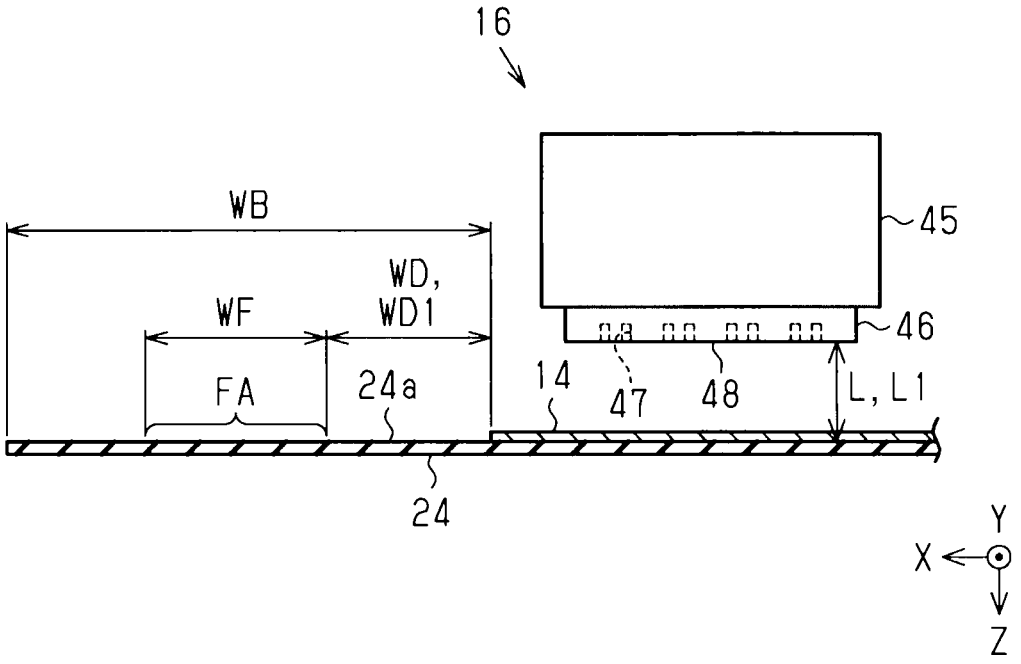
FIG. 5 is a schematic view illustrating the transport belt and a liquid ejecting unit.
Figure 6:
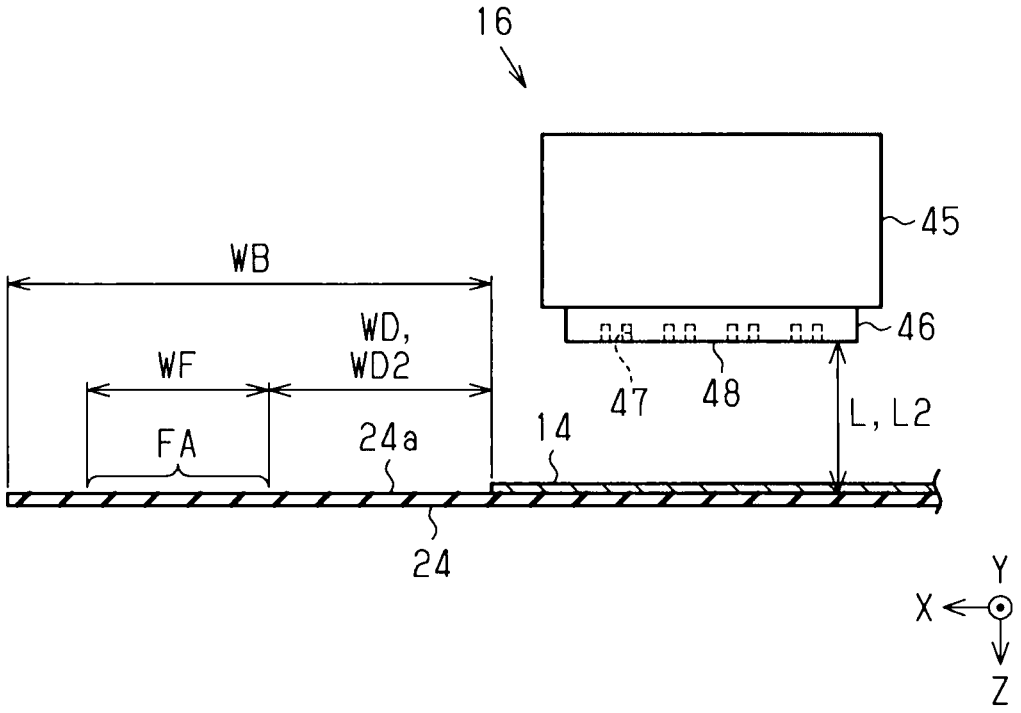
FIG. 6 is a schematic view illustrating the transport belt and a liquid ejecting unit.

As illustrated in FIGS. 5 and 6, when the distance L is a second distance L2 that is longer than a first distance L1, the controller 31 makes the interval WD larger than the interval WD when the distance L is the first distance L1. That is, the controller 31 sets the interval WD to a first interval WD1 when the distance L is the first distance L1, and sets the interval WD to a second interval WD2 that is larger than the first interval WD1 when the distance L is the second distance L2.

As illustrated in FIGS. 3 and 4, when the speed at which the liquid ejecting unit 16 moves is a second speed that is faster than a first speed, the controller 31 makes the interval WD larger than the interval WD when the speed is the first speed. That is, the controller 31 sets the interval WD to the first interval WD1 when the speed at which the liquid ejecting unit 16 moves is the first speed, and sets the interval WD to the second interval WD2 that is larger than the first interval WD1 when the speed is the second speed.

As illustrated in FIGS. 3 and 4, the liquid ejecting apparatus 11 includes a maintenance mechanism 70 for performing maintenance of the liquid ejecting unit 16. The maintenance mechanism 70 maintains the liquid ejecting unit 16 to prevent or resolve ejection failure caused by the clogging of the nozzles 47, mixing of air bubbles into the liquid ejecting head 46, attachment of the foreign matters to the peripheries of the nozzles 47, and the like.

The maintenance mechanism 70 includes a first liquid receiving portion 71 and a second liquid receiving portion 72 that receive the liquid ejected from the liquid ejecting head 46, a cleaning member 73 that wipes and cleans the nozzle surface 48, and a cleaning mechanism 74 that cleans the liquid ejecting head 46. It is preferable that the first liquid receiving portion 71 and the second liquid receiving portion 72 be provided on both sides of the transport belt 24 in the scanning direction X to be adjacent to the transport belt 24.

When the printing is not performed or when power is turned off, the liquid ejecting unit 16 stands by at a home position where the cleaning mechanism 74 is disposed. When the printing is performed, the liquid ejecting unit 16 alternately moves in either a first scanning direction X1 from the home position to the first liquid receiving portion 71 or a second scanning direction X2 returning from the first liquid receiving portion 71 to the home position.

The first liquid receiving portion 71 and the second liquid receiving portion 72 are provided in an area where the liquid ejecting head 46 is movable. The controller 31 causes any one of the first liquid receiving portion 71, the second liquid receiving portion 72, and the flushing area FA to perform the flushing operation of ejecting the liquid from the nozzles 47 as the flushing operation. The controller 31 performs switching between a first mode in which the liquid is ejected to the flushing area FA of the transport belt 24 as the flushing operation and a second mode in which liquid is ejected to the first liquid receiving portion 71 and the second liquid receiving portion 72.

The cleaning member 73 performs a wiping operation of wiping the nozzle surface 48 as the maintenance operation of the liquid ejecting head 46. The cleaning member 73 is formed of an elastic member such as rubber or resin elastomer and is formed in a thin plate shape. At least one of the cleaning member 73 and the liquid ejecting head 46 is configured to relatively move in the vertical direction Z between a wiping position where the cleaning member 73 and the nozzle surface 48 can come into contact with each other and a retracted position where the cleaning member 73 is separated from the nozzle surface 48 in the vertical direction Z. When the liquid ejecting head 46 moves in the scanning direction X and passes through the cleaning member 73 while being located in the wiping position, the cleaning member 73 and the liquid ejecting head 46 come into contact with the nozzle surface 48 to wipe the nozzle surface 48 while the cleaning member 73 is elastically deformed. That is, the cleaning member 73 moves relatively to the liquid ejecting unit 16 in the scanning direction X along the nozzle surface 48 to wipe the nozzle surface 48.

The cleaning mechanism 74 includes a suction cap 76, a suction tube 78 that connects the suction cap 76 and a waste liquid accommodating portion 77, and a suction pump 79 that sucks an inside of the suction cap 76. The suction pump 79 is, for example, a tube pump provided in the middle of the suction tube 78. At least one of the suction cap 76 and the liquid ejecting head 46 is configured to relatively move between a capping position in which a space where the nozzles 47 are opened is a closed space and a retracted position where the space where the nozzles 47 are opened is an opened space. The suction cap 76 and the liquid ejecting head 46 are disposed in the capping position so that capping is performed.

The suction cap 76 comes into contact with the liquid ejecting head 46 to form a closed space covering all the nozzles 47 at once. The cleaning mechanism 74 performs a cleaning operation as the maintenance operation of the liquid ejecting head 46, in which the suction pump 79 is driven to apply a negative pressure to the closed space formed by disposing the suction cap 76 at the capping position, so that the liquid is sucked from the nozzles 47.

Next, a maintenance method for the liquid ejecting apparatus 11 will be described with reference to a flowchart illustrated in FIG. 7. The controller 31 executes a mode selection routine at a timing when the printing is instructed to start, to select a mode of the maintenance operation.

Figure 7:
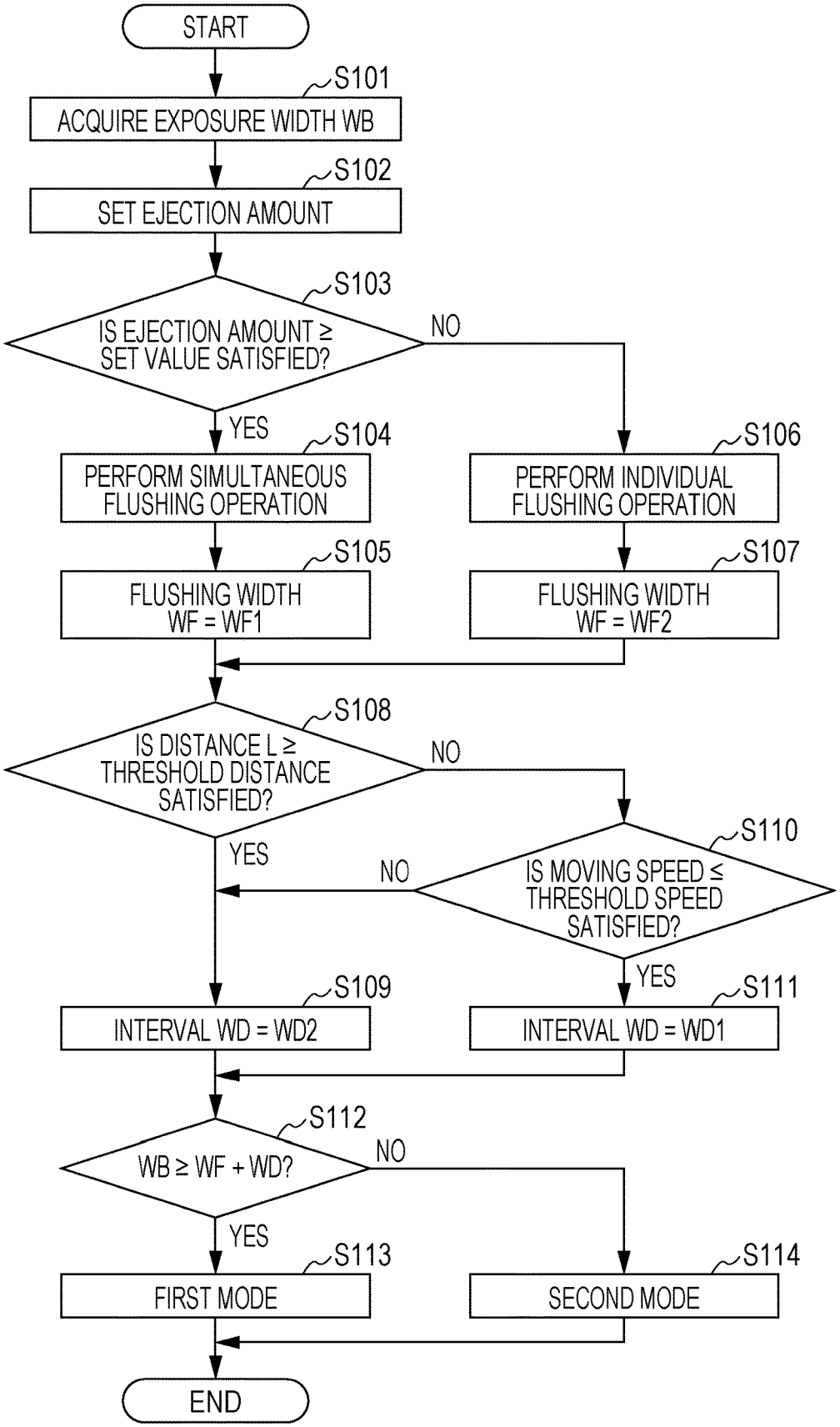
FIG. 7 is a flowchart illustrating a mode selection routine.

As illustrated in FIG. 7, the controller 31 acquires the exposure width WB in step S101, and sets the ejection amount which is the amount of the liquid ejected in the one flushing operation in step S102. The ejection amount is set according to the type of the liquid, the printing mode, and the like. Further, it is preferable that, for example, when a liquid that is easy to dry or a liquid that is easy to aggregate is used, the ejection amount increase. The ejection amount is changed according to the number of times by which the liquid is ejected in the one flushing operation. Therefore, the controller 31 may set the number of times by which the liquid is ejected in the one flushing operation.

In step S103, the controller 31 determines whether or not the ejection amount set in step S102 is equal to or more than a predetermined set value. When the ejection amount is equal to or more than the set value, the process proceeds to YES in step S103. The controller 31 selects the simultaneous flushing operation in step S104, and sets the flushing width WF as the first flushing width WF1 in step S105.

In step S103, when the ejection amount is less than the set value, the process proceeds to NO in step S103. The controller 31 selects the individual flushing operation in step S106, and sets the flushing width WF as the second flushing width WF2 in step S107.

In step S108, the controller 31 determines whether or not the distance L is equal to or more than a threshold distance. When the distance L is equal to or more than the threshold distance, the process proceeds to YES in S108. In step S109, the controller 31 sets the interval WD as the second interval WD2. When the distance L is less than the threshold distance, the process proceeds to NO in S108. The controller 31 causes the process to proceed to step S110.

In step S110, the controller 31 determines whether or not a moving speed at which the liquid ejecting unit 16 moves in the scanning direction X is equal to or less than a threshold speed. When the moving speed is equal to or less than the threshold speed, the process proceeds to YES in S110. In step S111, the controller 31 sets the interval WD as the first interval WD1. When the moving speed is more than the threshold speed, the process proceeds to NO in S110. The controller 31 causes the process to proceed to step S109.

In step S112, the controller 31 determines whether or not the sum of the set flushing width WF and the set interval WD is equal to or less than the exposure width WB. When the sum of the flushing width WF and the interval WD is equal to or less than the exposure width WB, the process proceeds to YES in S112. In step S113, the controller 31 selects the first mode. When the sum of the flushing width WF and the interval WD is more than the exposure width WB, the process proceeds to NO in S112. In step S114, the controller 31 selects the second mode.

Next, an operation of the liquid ejecting apparatus 11 when the flushing operation is performed in the selected mode will be described.

When the liquid ejecting apparatus 11 performs the printing on the medium 14, the controller 31 sets the kind of the flushing operation and the flushing mode according to the distance L, the speed at which the liquid ejecting unit 16 moves, the kind of the liquid, or the like. The controller 31 sequentially executes a printing operation of ejecting the liquid to the medium 14 while moving the liquid ejecting unit 16 in the scanning direction X, a transport operation of transporting the medium 14, and the flushing operation as the maintenance operation according to the set mode.

As illustrated in FIG. 3, a case where the individual flushing operation is performed on the flushing area FA spaced apart from the medium 14 by the first interval WD1 in the first mode will be described.

The controller 31 moves the liquid ejecting unit 16 located in the home position to a position where the liquid ejecting unit 16 passes through the flushing area FA in the first scanning direction X1. The controller 31 executes the flushing operation on the second liquid receiving portion 72 by ejecting the liquid at a timing when the liquid ejecting head 46 faces the second liquid receiving portion 72.

The controller 31 executes the printing operation of performing the printing on the medium 14 by ejecting the liquid at a timing when the liquid ejecting head 46 moving in the first scanning direction X1 faces the medium 14, and executes the individual flushing operation of ejecting the liquid at a timing when the liquid ejecting head 46 and the flushing area FA face each other. When the liquid ejecting head 46 passes through the flushing area FA, the controller 31 stops movement of the liquid ejecting unit 16, and executes the transport operation of transporting the medium 14.

Next, the controller 31 moves the liquid ejecting unit 16 to a position where the liquid ejecting unit 16 passes through the second liquid receiving portion 72 in the second scanning direction X2. The controller 31 executes the individual flushing operation at a timing when the liquid ejecting head 46 moving in the second scanning direction X2 and the flushing area FA face each other. The controller 31 executes the printing operation at a timing when the liquid ejecting head 46 faces the medium 14. The controller 31 ejects the liquid and executes the flushing operation at a timing when the liquid ejecting head 46 and the second liquid receiving portion 72 face each other. When the liquid ejecting head 46 passes through the second liquid receiving portion 72, the controller 31 stops movement of the liquid ejecting unit 16, and executes the transport operation of transporting the medium 14.

The controller 31 sequentially executes the printing operation, the flushing operation, and the transport operation, and performs the printing on the medium 14. The liquid attached to the flushing area FA is transferred to the cleaning unit 33 through an orbiting motion of the transport belt 24, and is cleaned by the cleaning unit 33.

When the flushing operation is performed in the second mode, the controller 31 changes the individual flushing operation performed on the flushing area FA to the flushing operation performed on the first liquid receiving portion 71, and sequentially executes the printing operation, the flushing operation, and the transport operation.

According to the above-described embodiment, the following effects can be obtained.

(1) The flushing area FA to which the liquid ejected by the flushing operation is attached is adjacent to the medium 14 with the interval WD therebetween. Therefore, as compared to a case where the flushing area FA is adjacent to the medium 14 without the interval WD therebetween, a possibility that the liquid is attached to the medium 14 can be reduced. Therefore, even when the liquid is ejected onto the transport belt 24 as the maintenance operation of the liquid ejecting head 46, a possibility that the medium 14 is contaminated by the ejected liquid can be reduced.

(2) In the flushing operation, as the distance L between the nozzle surface 48 and the medium supporting surface 24*a* becomes larger, mist occurs more easily. The generated mist floats and sticks to the medium 14, and contaminates the medium 14. In this point, the interval WD between the medium 14 and the flushing area FA is changed according to the distance L between the nozzle surface 48 and the medium supporting surface 24*a*. That is, when the distance L between the nozzle surface 48 and the medium supporting surface 24*a* is long, the interval WD between the medium 14 and the flushing area FA increases as compared to a case where the distance L is short. Therefore, a possibility that the mist is attached to the medium 14 can be reduced, and a possibility that the medium 14 is contaminated can be reduced.

(3) When the amount of the liquid ejected to the flushing area FA is equal to or more than a set value, the number of the attachment positions P3 of the liquid increases as compared to a case where the amount is less than the set value. When the liquid, the amount of which is equal to or more than a set value, is dispersed and attached to the many attachment positions P3, the surface area per volume of the liquid can increase, as compared to a case where the liquid, the amount of which is equal to or more than the set value, is attached to one attachment position P3. Therefore, the liquid can be easily evaporated, and fluidity of the liquid can be reduced.

(4) The controller 31 performs switching between a first mode in which the liquid is ejected to the medium supporting surface 24*a* and a second mode in which the liquid is ejected to the first liquid receiving portion 71 and the second liquid receiving portion 72. Therefore, when the printing or the maintenance is performed under a condition in which the liquid attached to the transport belt 24 is easy to be attached to the medium 14, a current mode can be switched to the second mode, and a possibility that the liquid is attached to the medium 14 can be reduced.

The above-described embodiment may be changed to modifications described below. The above-described embodiment and the following modifications may be combined with each other in a predetermined manner. Configurations included in the following modifications may be combined with each other in a predetermined manner.

First Modification

Figure 8:
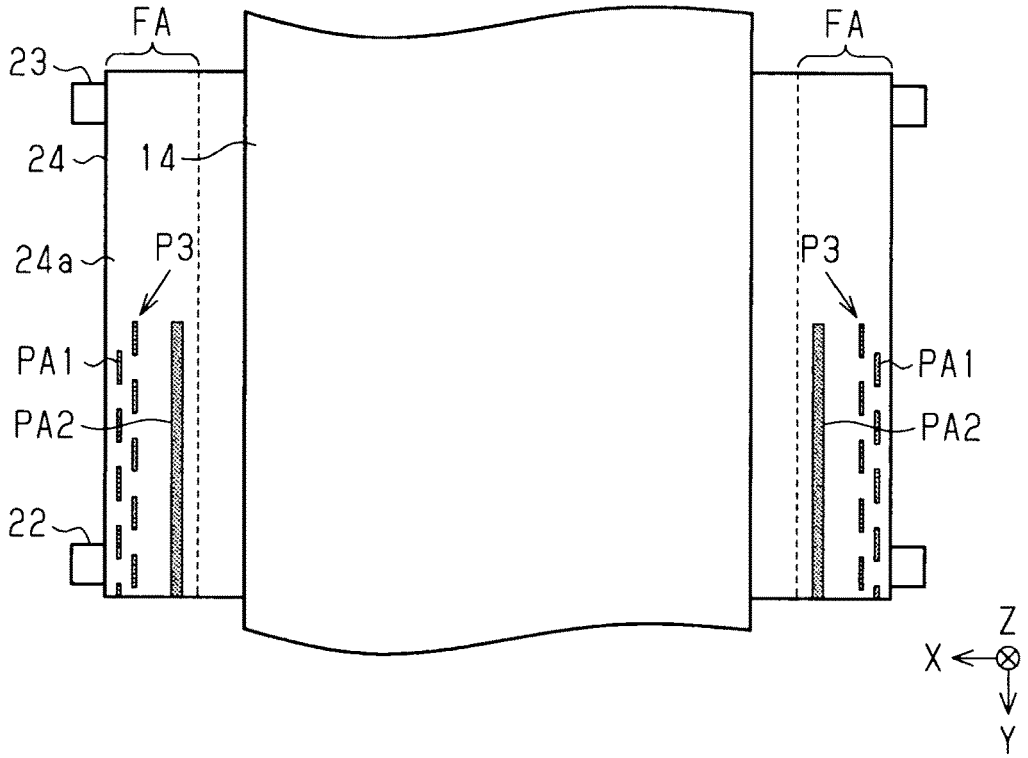
FIG. 8 is a schematic plan view illustrating the transport belt representing a pattern of a first modification.

As illustrated in FIG. 8, when viscosities of a plurality of liquids ejected from the liquid ejecting head 46 are different from each other, it is preferable that the controller 31 eject a liquid having the highest viscosity among the plurality of liquids to the medium 14 side in the scanning direction X rather than the other liquids, in the flushing operation.

In the flushing area FA, since a liquid having high viscosity is ejected to the medium 14 side rather than the other liquids, movement of the liquid having a low viscosity to the medium 14 side can be restricted by the liquid having a high viscosity, and a possibility that the liquid is attached to the medium 14 can be reduced.

As illustrated in FIG. 8, the controller 31 may form a continuous pattern PA2 which is an example of a pattern continuing in the transport direction Y by ejecting the liquid by the flushing operation. For example, it is preferable that the continuous pattern PA2 formed by the liquid having high viscosity be formed to continue in the transport direction Y at an end portion of the flushing area FA on the medium 14 side in the scanning direction X.

Since the continuous pattern PA2 continuing in the transport direction Y is formed at an end portion of the flushing area FA on the medium 14 side by the flushing operation, movement of the liquid attached to the flushing area FA toward the medium 14 can be restricted by the continuous pattern PA2, and a possibility that the liquid is attached to the medium 14 can be reduced.

The continuous pattern PA2 continuing in the transport direction Y may be formed at a predetermined position in the flushing area FA. The liquid attached to the transport belt 24 is sent to the cleaning unit 33 located below the printing position P1 in the vertical direction Z, through the orbiting motion of the transport belt 24. Therefore, a portion of the continuous pattern PA2, which is located on a downstream side of a portion of the continuous pattern PA2 located in the printing position P1 in the transport direction Y, is located on the lower side in the vertical direction Z. Therefore, in a state in which the liquid forming the continuous pattern PA2 may flow, the liquid is guided to a downstream side in the transport direction Y due to a height difference in a gravitational direction, and thus a possibility that the liquid flows in a direction intersecting the transport direction Y can be reduced.

The controller 31 may form the continuous pattern PA2 separately from the flushing operation. For example, the controller 31 may perform a pattern forming operation of forming the continuous pattern PA2 before the flushing operation is executed. Ejection data for forming the continuous pattern PA2 may be incorporated into ejection data for performing the printing on the medium 14. That is, in the printing operation on the medium 14, the controller 31 may perform the printing on a printing area that is wider than the width of the medium 14, and may form the continuous pattern PA2 at a position away from the medium 14 in the scanning direction X. In this case, an area from the continuous pattern PA2 to an end of the transport belt 24 in the scanning direction X is defined as the flushing area FA, and the controller 31 may perform the flushing operation in the flushing area FA subsequent to the formation of the continuous pattern PA2.

Second Modification

Figure 9:
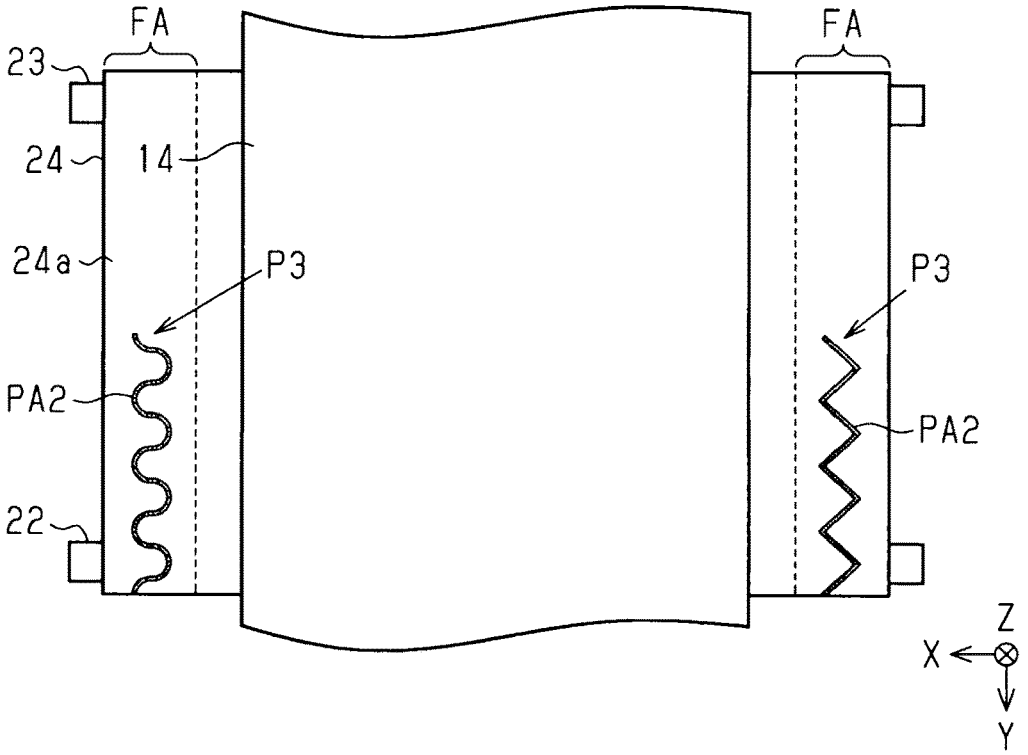
FIG. 9 is a schematic plan view illustrating the transport belt representing a pattern of a second modification.

As illustrated in FIG. 9, the continuous pattern PA2 may continue in the transport direction Y while a position thereof is changed in the scanning direction X. For example, the continuous pattern PA2 may continue in a wave shape, and may continue in a mountain shape.

The transport belt 24 may support the medium 14 through electrostatic adsorption. For example, the liquid ejecting apparatus 11 includes a charging mechanism for charging the medium 14, and may electrostatically adsorb the charged medium 14 and the transport belt 24.

The maintenance mechanism 70 includes a neglecting cap that caps the liquid ejecting head 46 when the liquid is not ejected, and forms a closed space that covers all the nozzles 47 at once. When the maintenance mechanism 70 includes the neglecting cap, it is preferable that the second liquid receiving portion 72, the cleaning member 73, the cleaning mechanism 74, and the neglecting cap be provided in an order from the transport belt 24 in the scanning direction X. The neglecting cap is used to restrain evaporation of the ink inside each nozzle 47 of the liquid ejecting head 46 when the printing is stopped or the liquid ejecting apparatus 11 is not used, and prevents occurrence of ejection failure.

The liquid ejecting head 46 may eject a liquid that is solidified when reacting with another liquid. In the flushing operation, it is preferable that the liquid that is solidified when reacting with the another liquid be attached to the medium 14 side rather than the another liquid in the flushing area FA.

The controller 31 may perform the flushing operation of ejecting the liquid from the stopped liquid ejecting head 46.

The controller 31 may perform the transport operation during the flushing operation.

The controller 31 may set the number of times by which the flushing operation is executed from execution of a previous printing operation to start of a next printing operation as one time. When a movement direction of the liquid ejecting unit 16 is changed, the controller 31 may execute the flushing operation either before or after the change.

The controller 31 may change the interval WD according to the number of times by which the liquid is ejected per unit time, the magnitude of a surface tension of the liquid, the temperature of the liquid, and the like in the flushing operation. For example, when the number of times by which the liquid is ejected per unit time is small, when the surface tension is low, and when the temperature is high, the interval WD may increase.

The liquid ejecting apparatus 11 may not include at least one of the first liquid receiving portion 71 and the second liquid receiving portion 72. The flushing operation may be performed on the transport belt 24.

The ejection amount of the liquid ejected in one flushing operation may be constant.

The number of the attachment positions P3 of the flushing area FA, to which the liquid is attached, in the flushing operation may be constant.

The controller 31 may set the number of the attachment positions P3 regardless of the ejection amount. The controller 31 may set the kind of the flushing operation regardless of the ejection amount. For example, when the sum of the first flushing width WF1 and the second interval WD2 is larger than the exposure width WB, and the sum of the second flushing width WF2 and the second interval WD2 is smaller than the exposure width WB, the controller 31 may execute the individual flushing operation.

When a difference between the exposure width WB and the interval WD is larger than the width of the nozzle rows 69 in the scanning direction X, the liquid may be simultaneously ejected from all the nozzle rows 69, and the liquid may be attached to the attachment positions P3, the number of which is the same as the number of the nozzle rows 69.

In the flushing operation, the liquid ejecting head 46 may intermittently eject the liquid from the nozzle rows 69, and may attach the liquid to the plurality of attachment positions P3 located at different positions in the scanning direction X.

The interval WD between the medium 14 and the flushing area FA may be constant.

The flushing width WF and the interval WD may be changed in three or more stages.

The interval WD may be changed regardless of the moving speed of the liquid ejecting unit 16. The interval WD may be changed regardless of the distance L between the nozzle surface 48 and the medium supporting surface 24*a*.

When so-called borderless printing is performed in which the size of a printing range such as a drawing pattern is set larger than the width of the medium 14 in the scanning direction X and an end of the printing range protrudes from an end of the medium 14 so that the printing is performed, it is preferable that the interval WD be set such that the end of the printing range and the flushing area FA are separated from each other in the scanning direction X.

In the individual flushing operation, the controller 31 may eject the liquid while changing positions of the plurality of nozzles 47 constituting the nozzle rows 69 of the liquid ejecting head 46 in the scanning direction X, and may increase the second flushing width WF2 by increasing the interval between the attachment positions P3 located at different positions in the scanning direction X. Thus, the second flushing width WF2 may be larger than the first flushing width WF1 when the simultaneous flushing operation is performed.

In the flushing operation, the controller 31 may eject the liquid while changing positions of the plurality of nozzles 47 constituting the nozzle rows 69 of the liquid ejecting head 46 in the scanning direction X, and may eject the liquid to the attachment positions P3, the number of which is the same as the ejection number of the liquid ejected from the plurality of nozzles 47 constituting the plurality of nozzle rows 69, and which are located at different positions.

The transport belt having adhesiveness may be configured using an adhesive layer formed by attaching a double-sided adhesive sheet formed of a polyester film or a nonwoven fabric as a base material to the medium supporting surface 24*a* instead of an adhesive layer formed by applying an adhesive to the medium supporting surface 24*a* of the transport belt 24.

The adhesive applied to the medium supporting surface 24*a* of the transport belt 24 and the double-sided adhesive sheet attached to the medium supporting surface 24*a* may be changed according to the kind of the medium 14. A rubber-based adhesive, an acrylic-based adhesive, a silicone-based adhesive, and the like containing natural rubber or synthetic rubber as a main component can be adopted as the adhesive, and one or more of these adhesives may be mixedly used. Further, an adhesive having liquid repellency may be adopted to facilitate removal of the liquid or the cleaning liquid attached to the medium supporting surface 24*a*. In this case, it is preferable that in the liquid repellency of the adhesive, from the viewpoint of removability of the liquid, a contact angle formed between the medium supporting surface 24*a* and droplets of the liquid ejected from the liquid ejecting head 46 be equal to or more than 60 degrees.

Meanwhile, when the liquid repellency of the adhesive is high and the contact angle formed between the medium supporting surface 24*a* and droplets of the liquid ejected from the liquid ejecting head 46 is large, there is a possibility that the liquid ejected to the flushing area FA by the flushing operation easily moves on the medium supporting surface 24*a* and is attached to the medium 14, due to an influence of air flow or the like caused by the transport operation of the transport belt 24 and a reciprocating motion of the carriage 45. From this viewpoint, it is preferable that the contact angle formed between the medium supporting surface 24*a* and the droplets of the liquid ejected from the liquid ejecting head 46 be smaller than 120 degrees, and it is more preferable that the contact angle be smaller than 90 degrees.

Further, the controller 31 may change a cleaning condition of the transport belt 24 by the cleaning unit 33 as a cleaning mechanism and a specification of the flushing operation, based on information on the adhesive and the double-sided adhesive sheet input by a not-illustrated operation panel or the like as an input unit. For example, when liquid repellency of an input second adhesive is higher than the liquid repellency of the first adhesive that has been used so far, the controller 31 may set the interval WD in the flushing operation to be larger than the interval WD in the case of the first adhesive. That is, as the contact angle formed between the medium supporting surface 24*a* and the droplets of the liquid ejected from the liquid ejecting head 46 becomes larger, the controller 31 may set the interval WD in the flushing operation to be larger.

Further, for example, when the liquid repellency of an input second adhesive is higher than the liquid repellency of the first adhesive that has been used so far, the controller 31 may set the flushing width WF in the flushing operation to be larger than the flushing width WF in the case of the first adhesive. That is, as the contact angle formed between the medium supporting surface 24*a* and the droplets of the liquid ejected from the liquid ejecting head 46 becomes larger, the controller 31 may set the flushing width WF in the flushing operation to be larger.

Further, for example, when the liquid repellency of the input second adhesive is higher than the liquid repellency of the first adhesive that has been used so far, the controller 31 may increase the number of the attachment positions P3 in the flushing area FA of the liquid ejected from the liquid ejecting head 46 in the flushing operation. That is, as the contact angle formed between the medium supporting surface 24*a* and the droplets of the liquid ejected from the liquid ejecting head 46 becomes larger, the controller 31 may increase the number of the attachment positions P3 in the flushing area FA of the liquid ejected from the liquid ejecting head 46 in the flushing operation.

The cleaning unit 33 as a cleaning mechanism may include the cleaning liquid accommodating portion 36.

The liquid ejecting apparatus 11 may be a line head type in which the printing range includes a line head over the entire width of the medium 14. Further, when the medium 14 is a single sheet cut in a predetermined size, the flushing operation may be performed in a flushing area FAT on the medium supporting surface 24*a* which is adjacent to the medium 14 with an interval WDT therebetween in the transport direction. Thus, the controller 31 may change an interval between the media 14 in the transport direction, based on the interval WDT set according to the kind of the flushing operation and the width of the flushing area FAT in the transport direction.

The liquid ejecting apparatus may a liquid ejecting apparatus that ejects or discharges liquid other than ink. Further, a state of the liquid discharged as a minute amount of the droplets from the liquid ejecting apparatus includes a grain state, a teardrop state, and a thread-like tail. Further, the liquid mentioned herein may be any material that can be ejected from the liquid ejecting apparatus. For example, the material is in a liquid phase state, and includes a fluid-state body such as liquid having high viscosity or low viscosity, sol, gel water, other inorganic solvents, an organic solvent, a solution, liquid resin, and liquid metal (metal melt). Further, the state of the material includes a solution obtained by dissolving, dispersing, and mixing, in a solvent, particles of a functional material made of a solid such as a pigment or metal particles, in addition to the liquid. Representative examples of the liquid include ink, liquid crystal, and the like as described in the above embodiment. Here, the ink includes various kinds of liquid compositions such as general water-based ink and oil-based ink, gel ink, hot melt ink and the like. As a specific example of the liquid ejecting apparatus, there is a liquid ejecting apparatus that ejects a liquid containing, in a dispersed or dissolved form, a material such as an electrode material and a coloring material used for manufacturing a liquid crystal display, an electroluminescence (EL) display, a surface emitting display, a color filter, or the like. Further, there may be a liquid ejecting apparatus that ejects a biological organic substance used for manufacturing a biochip, a liquid ejecting apparatus that is used as a precision pipette and ejects liquid as a sample, a textile printing apparatus, a micro dispenser, and the like. Further, there may be a liquid ejecting apparatus that ejects a lubricating oil to a precision machine such as a watch and a camera using a pinpoint, and a liquid ejecting apparatus that ejects a transparent resin liquid such as an ultraviolet curable resin onto a substrate to form a micro-hemispherical lens (an optical lens) used for an optical communication element. Further, there may be a liquid ejecting apparatus that ejects an etching solution such as acid or alkali to etch a substrate or the like.

Hereinafter, the technical spirit identified from the above-described embodiments and the modifications and effects thereof will be described.

A liquid ejecting apparatus includes a transport belt that transports a medium in a transport direction in a state in which the medium is supported on a medium supporting surface, a liquid ejecting head that ejects a liquid from a plurality of nozzles formed on a nozzle surface while moving in a scanning direction intersecting the transport direction with respect to the medium supported on the medium supporting surface of the transport belt, and a controller that performs a flushing operation of ejecting the liquid from the nozzles as a maintenance operation for the liquid ejecting head, on a flushing area on the medium supporting surface adjacent to the medium with an interval therebetween in the scanning direction.

With this configuration, the flushing area FA to which the liquid ejected by the flushing operation is attached is adjacent to the medium with the interval WD therebetween. Therefore, as compared to a case where the flushing area is adjacent to the medium without the interval therebetween, a possibility that the liquid is attached to the medium can be reduced. Therefore, even when the liquid is ejected onto the transport belt as the maintenance operation of the liquid ejecting head, a possibility that the medium is contaminated by the ejected liquid can be reduced.

In the liquid ejecting apparatus, when a distance between the nozzle surface and the medium supporting surface in a direction intersecting the transport direction and the scanning direction is a second distance that is longer than a first distance, the controller may set the interval to be larger than the interval when the distance is the first distance.

In the flushing operation, as the distance L between the nozzle surface and the medium supporting surface becomes larger, mist may occur more easily. The generated mist floats and sticks to the medium, and contaminates the medium. In this point, with this configuration, the interval between the medium and the flushing area is changed according to the distance between the nozzle surface and the medium supporting surface. That is, when the distance between the nozzle surface and the medium supporting surface is long, the interval between the medium and the flushing area increases as compared to a case where the distance is short. Therefore, a possibility that the mist is attached to the medium can be reduced, and a possibility that the medium is contaminated can be reduced.

In the liquid ejecting apparatus, when the amount of the liquid ejected to the flushing area is equal to or more than a set value, the controller may set an attachment position of the liquid on the flushing area to be larger than the attachment position when the amount of the liquid is less than the set value.

With this configuration, when the amount of the liquid ejected to the flushing area is equal to or more than a set value, the number of the attachment positions of the liquid may increase as compared to a case where the amount is less than the set value. When the liquid, the amount of which is equal to or more than a set value, is dispersed and attached to the many attachment positions, the surface area per volume of the liquid can increase, as compared to a case where the liquid, the amount of which is equal to or more than the set value, is attached to one attachment position. Therefore, the liquid can be easily evaporated, and fluidity of the liquid can be reduced.

The liquid ejecting apparatus further includes a liquid receiving portion that receives the liquid ejected from the liquid ejecting head in an area where the liquid ejecting head is movable, in which the controller performs switching between a first mode as the flushing operation in which the liquid is ejected to the transport belt and a second mode in which the liquid is ejected to the liquid receiving portion.

With this configuration, the controller may perform switching between a first mode in which the liquid is ejected to the medium supporting surface and a second mode in which the liquid is ejected to the first liquid receiving portion. Therefore, when the printing or the maintenance is performed under a condition in which the liquid attached to the transport belt is easy to be attached to the medium, a current mode can be switched to the second mode, and a possibility that the liquid is attached to the medium can be reduced.

There is provided a maintenance method for a liquid ejecting apparatus, the liquid ejecting apparatus including a transport belt that transports a medium in a transport direction in a state in which the medium is supported on a medium supporting surface, and a liquid ejecting head that ejects a liquid from a plurality of nozzles formed on a nozzle surface while moving in a scanning direction intersecting the transport direction with respect to the medium supported on the medium supporting surface of the transport belt, in which a flushing operation of ejecting the liquid from the nozzles as a maintenance operation of the liquid ejecting head is performed on a flushing area on the medium supporting surface adjacent to the medium with an interval therebetween in the scanning direction.

According to this method, the same effect as the liquid ejecting apparatus can be obtained.

In the maintenance method for the liquid ejecting apparatus, in the flushing operation, when a distance between the nozzle surface and the medium supporting surface in a direction intersecting the transport direction and the scanning direction is a second distance that is longer than a first distance, the interval may be set to be larger than the interval when the distance is the first distance.

According to this method, the same effect as the liquid ejecting apparatus can be obtained.

In the maintenance method for the liquid ejecting apparatus, in the flushing operation, when the amount of the liquid ejected to the flushing area is equal to or more than a set value, the attachment position of the liquid on the flushing area may be set to be larger than the attachment position when the amount of the liquid is less than the set value.

According to this method, the same effect as the liquid ejecting apparatus can be obtained.

In the maintenance method for the liquid ejecting apparatus, the liquid ejecting apparatus may be disposed on the nozzle surface such that the plurality of nozzles form a plurality of nozzle rows arranged in the scanning direction, and ejects a plurality of different kinds of liquids from the plurality of nozzle rows, and in the flushing operation, a liquid having the highest viscosity among the plurality of liquids may be ejected to the medium side in the scanning direction from the other liquids.

According to this method, in the flushing area, a liquid having high viscosity is ejected to the medium side rather than the other liquids. Therefore, movement of the liquid having a low viscosity to the medium side can be restricted by the liquid having a high viscosity, and a possibility that the liquid is attached to the medium can be reduced.

In the maintenance method for the liquid ejecting apparatus, in the scanning direction, a pattern continuing in the transport direction is formed at an end portion of the flushing area on the medium side by ejecting the liquid by the flushing operation.

According to this method, a pattern continuing in the transport direction is formed at an end portion of the flushing area on the medium side by the flushing operation. Therefore, movement of the liquid attached to the flushing area to the medium side can be restricted by the pattern, and a possibility that the liquid is attached to the medium can be reduced.

In the maintenance method for the liquid ejecting apparatus, the liquid ejecting apparatus further includes a liquid receiving portion that receives the liquid ejected from the liquid ejecting head in an area where the liquid ejecting head is movable, in which switching between a first mode in which the liquid is ejected to the medium supporting surface and a second mode in which the liquid is ejected to the liquid receiving portion is performed as the flushing operation.

According to this method, the same effect as the liquid ejecting apparatus can be obtained.

A liquid ejecting apparatus includes a transport belt that transports a medium in a transport direction in a state in which the medium is supported on a medium supporting surface, a liquid ejecting head that ejects a liquid from a plurality of nozzles formed on a nozzle surface with respect to the medium supported on the medium supporting surface of the transport belt, and a controller that performs a flushing operation of ejecting the liquid from the nozzles as a maintenance operation for the liquid ejecting head, on a flushing area on the medium supporting surface adjacent to the medium with an interval therebetween.

With this configuration, the flushing area to which the liquid ejected by the flushing operation is attached is adjacent to the medium with the interval therebetween. Therefore, as compared to a case where the flushing area is adjacent to the medium without the interval therebetween, a possibility that the liquid is attached to the medium can be reduced. Therefore, even when the liquid is ejected onto the transport belt as the maintenance operation of the liquid ejecting head, a possibility that the medium is contaminated by the ejected liquid can be reduced.

In the liquid ejecting apparatus, the controller may increase the number of attachment positions of the liquid on the flushing area as a contact angle formed between the medium supporting surface and droplets of the liquid becomes larger.

With this configuration, as the contact angle formed between the medium supporting surface and droplets of the liquid becomes larger, the number of the attachment positions of the liquid on the flushing area may increase. When the liquid is dispersed and attached to many attachment positions, a possibility that the liquid ejected to the flushing area of the medium supporting surface is integrated and easily moves, as compared to a case where the liquid is attached to one attachment position. Therefore, a possibility that the medium is contaminated can be reduced.

In the liquid ejecting apparatus, the controller may perform the flushing operation such that the liquid ejected from the nozzles is attached to different positions of the flushing area.

With this configuration, the flushing operation may be performed such that the liquid ejected from the nozzles is attached to different positions of the flushing area. When the liquid ejected from the nozzles is attached to different positions of the flushing area, a possibility that the liquid ejected to the flushing area of the medium supporting surface is integrated and easily moves, as compared to a case where a plurality of liquids are attached to one attachment position. Therefore, a possibility that the medium is contaminated can be reduced.

In the liquid ejecting apparatus, the controller increases the interval as a contact angle formed between the medium supporting surface and droplets of the liquid becomes larger.

With this configuration, as the contact angle formed between the medium supporting surface and droplets of the liquid becomes larger, the interval between the medium and the flushing area of the medium supporting surface increases. When the interval increases, a possibility that the liquid ejected to the flushing area of the medium supporting surface is integrated and easily moves, as compared to a case where the interval is small. Therefore, a possibility that the medium is contaminated can be reduced.

In the liquid ejecting apparatus, a contact angle formed between the medium supporting surface and droplets of the liquid is equal to or more than 60 degrees and is less than 90 degrees.

With this configuration, while removability of the liquid attached to the medium supporting surface is ensured, the liquid ejected to the flushing area of the medium supporting surface moves, and thus a possibility that the medium is contaminated can be reduced.

There is provided a maintenance method for a liquid ejecting apparatus, the liquid ejecting apparatus including a transport belt that transports a medium in a transport direction in a state in which the medium is supported on a medium supporting surface, and a liquid ejecting head that ejects a liquid from a plurality of nozzles formed on a nozzle surface with respect to the medium supported on the medium supporting surface of the transport belt, in which a flushing operation of ejecting the liquid from the nozzles as a maintenance operation of the liquid ejecting head is performed in a flushing area on the medium supporting surface adjacent to the medium with an interval therebetween.

According to this method, the same effect as the liquid ejecting apparatus can be obtained.

In the maintenance method for the liquid ejecting apparatus, as a contact angle formed between the medium supporting surface and droplets of the liquid becomes larger, the number of attachment positions of the liquid on the flushing area increases.

According to this method, the same effect as the liquid ejecting apparatus can be obtained.

In the maintenance method for the liquid ejecting apparatus, the flushing operation is performed such that the liquid ejected from the nozzles is attached to different positions of the flushing area.

According to this method, the same effect as the liquid ejecting apparatus can be obtained.

In the maintenance method for the liquid ejecting apparatus, the liquid ejecting head is movable in a scanning direction intersecting the transport direction, and is disposed on the nozzle surface such that the plurality of nozzles form a plurality of nozzle rows arranged in the scanning direction, and in the flushing operation, the flushing operation is performed such that the liquid ejected from the nozzles is attached to different positions of the flushing area in each of the plurality of nozzle rows.

According to this method, a possibility that a plurality of liquids ejected from the plurality of nozzle rows to the flushing area of the medium supporting surface are integrated and easily move can be reduced. Therefore, a possibility that the medium is contaminated can be reduced.

The entire disclosure of Japanese Patent Application No. 2018-022824, filed Feb. 13, 2018 and No. 2018-171610, filed Sep. 13, 2018 are expressly incorporated by reference herein.

What is claimed is:

1. A liquid ejecting apparatus comprising:

a transport belt that transports a medium in a transport direction in a state in which the medium is supported on a medium supporting surface;

a liquid ejecting head that ejects a liquid from a plurality of nozzles formed on a nozzle surface while moving in a scanning direction intersecting the transport direction with respect to the medium supported on the medium supporting surface of the transport belt; and a controller that performs a flushing operation of ejecting the liquid from the nozzles as a maintenance operation for the liquid ejecting head, on a flushing area on the medium supporting surface adjacent to the medium with an interval therebetween in the scanning direction, wherein the interval in the scanning direction between the medium and the flushing area is provided on the medium supporting surface by the controller.

2. The liquid ejecting apparatus according to claim 1, wherein when a distance between the nozzle surface and the medium supporting surface in a direction intersecting the transport direction and the scanning direction is a second distance that is longer than a first distance, the controller sets the interval to be larger than the interval when the distance is the first distance.

3. The liquid ejecting apparatus according to claim 1, wherein when the amount of the liquid ejected to the flushing area is equal to or more than a set value, the controller sets an attachment position of the liquid on the flushing area to be larger than the attachment position when the amount of the liquid is less than the set value.

4. The liquid ejecting apparatus according to claim 1, further comprising:

a liquid receiving portion that receives the liquid ejected from the liquid ejecting head in an area where the liquid ejecting head is movable, wherein the controller performs switching between a first mode as the flushing operation in which the liquid is ejected to the transport belt and a second mode in which the liquid is ejected to the liquid receiving portion.

5. A maintenance method of a liquid ejecting apparatus, the liquid ejecting apparatus including a transport belt that transports a medium in a transport direction in a state in which the medium is supported on a medium supporting surface, and a liquid ejecting head that ejects a liquid from a plurality of nozzles formed on a nozzle surface while moving in a scanning direction intersecting the transport direction with respect to the medium supported on the medium supporting surface of the transport belt, the method comprising:

performing a flushing operation of ejecting the liquid from the nozzles as a maintenance operation of the liquid ejecting head is performed on a flushing area on the medium supporting surface adjacent to the medium with an interval therebetween in the scanning direction;

setting a width of the flushing area before the flushing operation is performed; and setting the interval in the scanning direction between the medium and the flushing area after the width of the flushing area is set.

6. The maintenance method of a liquid ejecting apparatus according to claim 5, wherein in the flushing operation, when a distance between the nozzle surface and the medium supporting surface in a direction intersecting the transport direction and the scanning direction is a second distance that is longer than a first distance, the interval is set to be larger than the interval when the distance is the first distance.

7. The maintenance method of a liquid ejecting apparatus according to claim 5, wherein in the flushing operation, when the amount of the liquid ejected to the flushing area is equal to or more than a set value, the attachment position of the liquid on the flushing area is set to be larger than the attachment position when the amount of the liquid is less than the set value.

8. The maintenance method of a liquid ejecting apparatus according to claim 5, wherein the liquid ejecting apparatus is disposed on the nozzle surface such that the plurality of nozzles form a plurality of nozzle rows arranged in the scanning direction, and ejects a plurality of different kinds of liquids from the plurality of nozzle rows, and wherein in the flushing operation, a liquid having the highest viscosity among the plurality of liquids is ejected to the medium side in the scanning direction from the other liquids.

9. The maintenance method of a liquid ejecting apparatus according to claim 5, wherein in the scanning direction, a pattern continuing in the transport direction is formed at an end portion of the flushing area on the medium side by ejecting the liquid by the flushing operation.

10. The maintenance method of a liquid ejecting apparatus according to claim 5, wherein the liquid ejecting apparatus includes a liquid receiving portion that receives the liquid ejected from the liquid ejecting head in an area where the liquid ejecting head is movable, and wherein switching between a first mode in which the liquid is ejected to the medium supporting surface and a second mode in which the liquid is ejected to the liquid receiving portion is performed as the flushing operation.

11. A liquid ejecting apparatus comprising:

a transport belt that transports a medium in a transport direction in a state in which the medium is supported on a medium supporting surface;

a liquid ejecting head that ejects a liquid from a plurality of nozzles formed on a nozzle surface with respect to the medium supported on the medium supporting surface of the transport belt; and a controller that performs a flushing operation of ejecting the liquid from the nozzles as a maintenance operation for the liquid ejecting head, on a flushing area on the medium supporting surface adjacent to the medium with an interval therebetween, wherein the interval between the medium and the flushing area is provided on the medium supporting surface by the controller, and wherein the controller is configured to change a specification of the flushing operation based on a liquid repellency of the medium supporting surface.

12. The liquid ejecting apparatus according to claim 11, wherein the controller increases the number of attachment positions of the liquid on the flushing area as a contact angle formed between the medium supporting surface and droplets of the liquid becomes larger.

13. The liquid ejecting apparatus according to claim 11, wherein the controller performs the flushing operation such that the liquid ejected from the nozzles is attached to different positions of the flushing area.

14. The liquid ejecting apparatus according to claim 11, wherein the controller increases the interval as a contact angle formed between the medium supporting surface and droplets of the liquid becomes larger.

15. The liquid ejecting apparatus according to claim 11, wherein a contact angle formed between the medium supporting surface and droplets of the liquid is equal to or more than 60 degrees and is less than 90 degrees.

16. The liquid ejecting apparatus according to claim 11, further comprising: an input portion configured to input an information related to liquid repellency of the medium supporting surface.

17. A maintenance method of a liquid ejecting apparatus, the liquid ejecting apparatus including a transport belt that transports a medium in a transport direction in a state in which the medium is supported on a medium supporting surface, and a liquid ejecting head that ejects a liquid from a plurality of nozzles formed on a nozzle surface with respect to the medium supported on the medium supporting surface of the transport belt, the method comprising:

performing a flushing operation of ejecting the liquid from the nozzles as a maintenance operation of the liquid ejecting head is performed on a flushing area on the medium supporting surface adjacent to the medium with an interval therebetween; and setting the interval on the medium supporting surface between the medium and the flushing area before the flushing operation is performed, wherein a specification of the flushing operation is changed based on a liquid repellency of the medium supporting surface.

18. The maintenance method of a liquid ejecting apparatus according to claim 17, wherein as a contact angle formed between the medium supporting surface and droplets of the liquid becomes larger, the number of attachment positions of the liquid on the flushing area increases.

19. The maintenance method of a liquid ejecting apparatus according to claim 17, wherein the flushing operation is performed such that the liquid ejected from the nozzles is attached to different positions of the flushing area.

20. The maintenance method of a liquid ejecting apparatus according to claim 17, wherein the liquid ejecting head is movable in a scanning direction intersecting the transport direction, and is disposed on the nozzle surface such that the plurality of nozzles form a plurality of nozzle rows arranged in the scanning direction, and wherein in the flushing operation, the flushing operation is performed such that the liquid ejected from the nozzles is attached to different positions of the flushing area in each of the plurality of nozzle rows.

* * * * *